109-84 SR
8/22/78 XR 4,108,087

United States Patent [19] [11] 4,108,087
Sebesta [45] Aug. 22, 1978

[54] FLOOR SAFE

[76] Inventor: Walter C. Sebesta, 8651 Foothill Blvd., Cucamonga, Calif. 91730

[21] Appl. No.: 855,972

[22] Filed: Nov. 30, 1977

[51] Int. Cl.[2] ..... E05G 1/024
[52] U.S. Cl. ..... 109/51; 109/72; 109/79; 109/84
[58] Field of Search ..... 109/50, 51, 52, 58, 109/64, 72, 78, 79, 84

[56] References Cited

U.S. PATENT DOCUMENTS

| | | | |
|---|---|---|---|
| 727,105 | 5/1903 | Dodson | 109/51 |
| 873,878 | 12/1907 | Lowrie | 109/50 X |
| 891,969 | 6/1908 | Anderson | 109/50 |
| 1,644,410 | 10/1927 | Belknap | 109/50 |
| 1,717,682 | 6/1929 | Hahn | 109/51 X |

*Primary Examiner*—Mervin Stein
*Assistant Examiner*—David H. Corbin
*Attorney, Agent, or Firm*—Georges A. Maxwell

[57] ABSTRACT

A floor safe engageable in and through a rectangular opening in a wood floor and between opposing sides of laterally spaced joists supporting the floor, said safe including an upwardly opening rectangular box-like body with a horizontal bottom wall and flat vertical side walls slidably arranged in said opening in the floor and between said joists with opposite side wall in substantial flat bearing engagement with said sides of the joists; fastening means fixing the body to the joists including apertures in said opposite side walls and elongate headed fasteners engaged through the openings and into the joists from within the body, a flat horizontal cover plate in overlying supported engagement with the top of the body and having a top surface substantially flush with the floor; said cover plate has a central vertical access opening, releasable coupling means securing the cover plate in tight engagement with the body and including laterally projecting brackets on said side walls between the ends thereof, vertical studs depending from the cover plate and engaged through the brackets and nuts engaged on the studs and advanced upwardly into tight engagement with the brackets, said nuts, studs and brackets being freely manually accessible from above the floor through the access opening and within the body, a flat horizontal closure plate removably engaged in the access opening and locking means releasably locking said closure plate in the access opening.

10 Claims, 10 Drawing Figures

2
2
5
5
7
7
J
J
21
21
D
D
P
P
95
95
33
33
32
M
M
M
M
E
E
E
E
C
O
68
52
70
69
X
I
15
12
30
76
90
90
77
78
14
40
41
74
75

FLOOR SAFE

This invention has to do with safes and is particularly concerned with an improved floor safe.

In the art of safes there is that type of safe which is intended to be mounted in a floor structure and which is commonly called a floor safe. Floor safes are small compact box-like units with flat top walls or surfaces and adapted to be arranged within a related floor structure of a dwelling house or the like with their top surfaces substantially flush with the surface of the floor. The top surfaces of the units are provided with access openings with related closures to normally close the access openings. Such safes are provided with suitable combination or key-operated locking devices to releasably retain the closures in closed relationship in the access openings.

Floor safes of the character referred to above are generally rather small, compact and light-weight structures with limited holding capacity and are particularly suitable for personal, domestic use.

Ordinarily, floor safes are such that if they are not suitably mounted, tied in or incorporated with a related floor structure, they are subject to being carried away by thieves and are particularly vulnerable to being broken into. Accordingly, floor safe structures of the general character here concerned with rely heavily or depend upon their related floor structures to impart and provide that reasonable and practical degree of security a safe structure is expected to provide.

One type or sub-class of floor safe which has proven to be effective and which has met with notable commercial success is that class of floor safe which is constructed especially for incorporation in or with steel reinforced poured concrete floor structures. Due to the nature of such floor structures and the manner in which they are established, floor safes related to them are integrated in the floor structures in such a manner that they cannot, under ordinary circumstances, be separated and removed from the floor structures and cannot be readily tampered with or broken into, except at or about their exposed top surfaces and closures, which surfaces and closures are ordinarily designed and constructed to prevent or impede successful tampering and the like.

A major shortcoming of the above noted subclass of safe structure resides in the fact that the safes must be installed at the time the concrete floors are established or, an extensive area of established floor, where the safes are to be installed, must be destroyed, removed and then replaced with new iron and concrete at the time of and in the course of installing the safes. Such a procedure is costly, destructive, requires the use of special tools and equipment and requires the exercise of special and unique skills not possessed by the ordinary home owner or landlord.

Since safes are not ordinarily provided or installed in dwelling places and the like at the time such places are built and since such safes cannot be easily and conveniently installed by the ordinary home owner or the like, installation of the above noted subclass of floor safe is substantially restricted to commercial establishments and/or buildings where the need for such a safe is anticipated at the time of constructing the buildings or where security demands dictate and justify the cost and burden of late installation of the safes.

Another sub-class of floor safe which, to date, has met with less or questionable public acceptance and commercial success is that class of box-like safe structure which is adapted to be engaged in and related to a wood floor structure.

This second sub-class of floor safe is structurally similar to the above and first considered sub-class of floor safe and distinguishes therefrom by the provision or inclusion of exterior mounting means comprised of mounting straps and brackets which facilitate mounting the safes in their related wood floor structures. Such safes are intended to be arranged between and secured to adjacent wood floor joists of related floor structures, below and in vertical alignment with openings cut in the flooring supported atop the joints and which commonly includes wood substrates, or sub-flooring, wood topstrates or finished floor, and in many instances, floor coverings such as linoleum or carpet and padding.

The mounting means provided in this last class of safe construction commonly comprises a plurality of apertured metal straps, plates, angle brackets and the like fixed to and projecting from the exterior of the box-like bodies of the safes to engage related floor joists at locations spaced outward from the safe bodies a sufficient distance to permit or enable the installer to engage fastener means such as nails or lag bolts, through the apertures and into the joists.

It will be apparent from the foregoing that in order to install the above noted sub-class of floor safes in established or existing wood floor structures and in order to provide access to the fastening means and effect securing the safes to adjacent related floor joists, large or extensive area of the floor structures, above the joists, must be cut away and removed. Following securing of the safes to the joists, new floor structure must be built about the upper portion of the safes, to replace that original flooring which was removed to facilitate installation of the safes. Such a procedure not only requires a major and costly floor remodeling or rebuilding operation, which should only be undertaken by a skilled journeyman carpenter, but inevitably results in a patched floor structure which is aesthetically undesirable.

More important, the above noted kind of safe installation results in a finished structure which is such that a thief with simple readily available tools can easily and quickly remove the apparent patched portion of the floor about the safe, gain ready access to the fastening means and, with little effort and in a minimum period of time, remove and carry the entire safe structure away for the purpose of breaking it open and removing its contents.

While ease of the removal of the above noted safes from their related wood floor structures is commonly recognized and diminishes their effectiveness and desirability, the principal shortcoming of such safes resides in the fact that they cannot be easily and conveniently installed by the ordinary home owner at little cost and with little adverse visible effects to the surrounding related floor structure. Rather, installation of these safe structures requires the costly services of highly skilled labor, such as journeyman finish carpenters and cabinet makers to assure structurally effective and visually acceptable installations.

An object and feature of my invention is to provide an improved floor safe structure which is such that it can be easily and effectively fixed to related joists of a standard wood floor structure through a vertical opening established in the floor through which the safe is slidably engageable and in which the upper portion of the safe is fitted when installation is complete.

It is an object and feature of the present invention to provide a floor safe structure of the general character referred to including an upwardly opening box-like body which is substantially the same in plan configuration with the plan configuration of a safe receiving opening established in the floor with which the safe is related; said body has two opposite parallel vertical sides which are spaced apart a distance which is substantially equal to the standard distance between opposing parallel vertical sides of adjacent floor joists, whereby the body is engageable through the opening in the floor for arrangement between the joists supporting the floor with said opposite sides of the body in substantial flat opposing juxtaposition with said opposing surfaces of the joists.

Another object and feature of my invention is to provide a safe structure of the character referred to above wherein said opposite sides of the body have fastener receiving openings to accommodate related fastening means to fix the body to the joists, which fastener receiving openings and the fastening means related thereto are freely accessible from the open top of the body and through the opening in the floor whereby the body is fixed to the joists through the floor opening and from within the interior of the body.

An object and feature of the invention is to provide a safe structure of the character referred to wherein the fastening means securing the safe to its related floor structure are inaccessible at the exterior of the construction.

Still another object and feature of my invention is to provide a safe structure of the general character referred to above which includes a cover with a substantially centrally located vertical access opening, which cover is coextensive with and normally overlies the open top of the body and screw mounting means releasably securing the cover to the body, which mounting means is arranged wholly within the safe and is only accessible through the access opening, whereby release of said mounting means and disengagement of the cover from the body cannot be effected from outside the safe construction.

Yet another object and feature of the present invention is to provide separable novel fire and heat insulating means which is easily and conveniently engageable in the body from the open top thereof after the body is securely mounted in its related floor structure.

It is an object and feature of the present invention to provide a floor safe structure of the character referred to above including a closure releasably engageable in the access opening in the cover, breach-tip returning means between the cover and the closure and novel locking means releasably locking the closure in said access opening.

Other objects and features of the present invention are to provide an improved floor safe structure of the general character referred to above which is easy and economical to manufacture; easy and quick to install with the exercise of ordinary non-professional carpentry skills, utilizing a common drill, saw, wrench and hammer; and, a structure which is durable, strong and substantially tamper proof when installed.

The foregoing and other objects and features of my invention will be fully understood from the following detailed description of one typical preferred form and application of the invention throughout which description reference is made to the accompanying drawings, in which.

Figure 1:
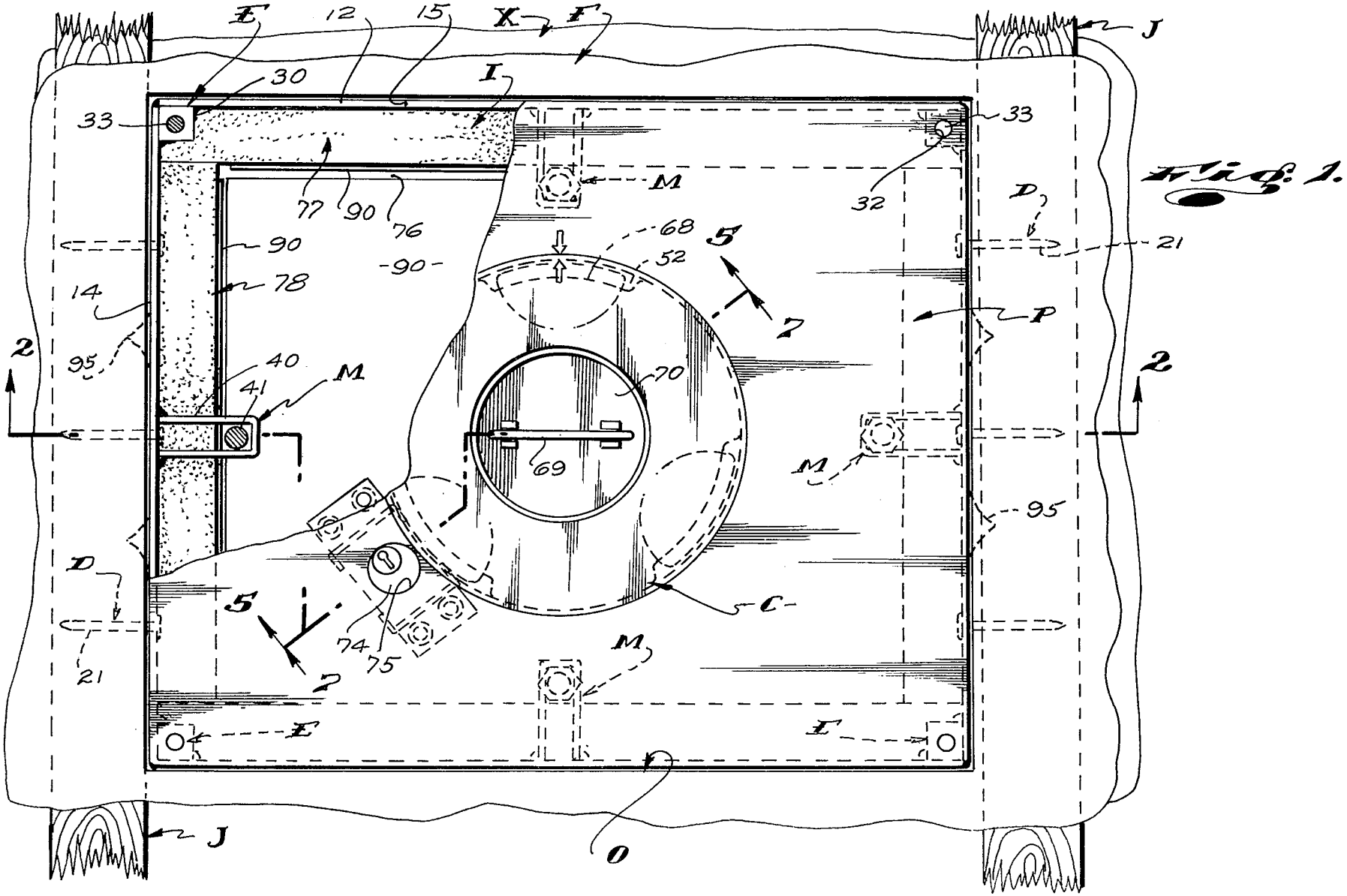
FIG. 1 is a top view of my new safe with portions broken away to show details of the construction.

Referring to the drawings, the safe construction S and I provide is, basically, a box-like structure having flat, horizontal top and bottom walls 10 and 11, like flat vertical side walls 12 and like flat vertical end walls 14. The top wall 10 is provided with an access opening A to provide access to the interior of the box-like structure and which a closure C under control of a locking device L is normally removably engaged.

The construction S is intended and is particularly suited by engagement or incorporation in a wood floor structure comprising a plurality of elongate horizontal, laterlly spaced floor joists J arranged so that adjacent joists have laterally spaced, flat, vertical opposing sides, and a flat horizontal floor F overlying the joists J in fixed supported engagement thereon.

While I have shown the floor F as including a single thickness of wood or material, it is to be understood that in practice, it can be a laminate structure including, for example, a substrate or subflooring and a topstrate or finished flooring. Additionally, the floor F might include a top floor covering of linoleum or the like or suitable carpeting with or without carpet padding.

The construction A is adapted to be engaged in an opening O in the floor F and between a pair of adjacent joists J with the top wall 10 substantially flush with the top surface of the floor F and with the end walls 14 in substantial flat bearing engagement with and fixed to the opposing sides of the adjacent joists J.

In furtherance of the present invention, the safe construction A is designed and proportioned to be cooperatively related with a standard wood floor structure which is built in accordance with those building codes which have been adopted by the majority of governmental agencies which oversee the construction of new buildings and which are rigorously enforced. Since there are a limited number of different code requirements for wood floor structures, each depending upon the nature and use to which a building is to be put and each of which provides for different, though specific, lateral spacing of floor joists, it is a feature of this invention to provide a safe structure which is particularly suited to be cooperatively related in and with one or two standard or "code" floor structures.

For the purpose of this disclosure, I have shown and will describe the safe S as being designed for engagement in and related to a standard wood floor structure having 2 by 6 inch joists arranged in parallel relationship on 16 inch centers. In accordance with standard dimensioning of finished lumber, 2 by 6 inch joists are in fact $1\frac{5}{8}$ by $5\frac{5}{8}$ inches and are such that when they are set on 16 inch center, the flat vertical sides of each joist are spaced $14\frac{3}{8}$ inches from the opposing flat sides of their next adjacent joists. While the opposing sides of adjacent joists are theoretically, or supposed to be, $14\frac{3}{8}$ inches apart, due to dimensional errors in lumber and in the placement of joists during construction of a floor, it is not uncommon to find the opposing surfaces or sides of adjacent joists spaced $14\frac{1}{4}$ inches to $14\frac{1}{2}$ inches apart. That is, tolerances of about $\frac{1}{8}$ inch plus or minus is to be anticipated in the spacing of opposing surfaces or sides of adjacent joists in a standard floor structure.

In light of the foregoing, a safe construction of which two opposite ends are $14\frac{1}{8}$ inches apart will in an overwhelming number of instances enter freely between a pair of adjacent joists J of a floor structure with at least one side or end in flat bearing engagement with the side of one joist and with its other or opposite side or end in similar engagement or spaced no more than $\frac{1}{4}$ inch from its related joist.

In accordance with the above, one horizontal dimension of the safe S is approximately $\frac{1}{8}$ inch less than the code required lateral distance between the opposing sides of adjacent joists of the floor structure with which it is to be related. Opposite sides or ends of the safe establish flat bearing engagement with cross member joists or end plate that establish establishes the end of the room.

In the example given and in the case illustrated, the longitudinal extent or the dimension of the safe S from one end 14 to the other is preferably $14\frac{1}{8}$ inches.

The lateral extent of dimension of the safe S from one end 12 to the otheris twelve inches. In some cases the twelve inch lateral side must be positioned between floor joists leaving an air space of $2\frac{3}{8}$ inches for air condition cold-air return where such floor designs exist.

Figures 2, 3, 4:
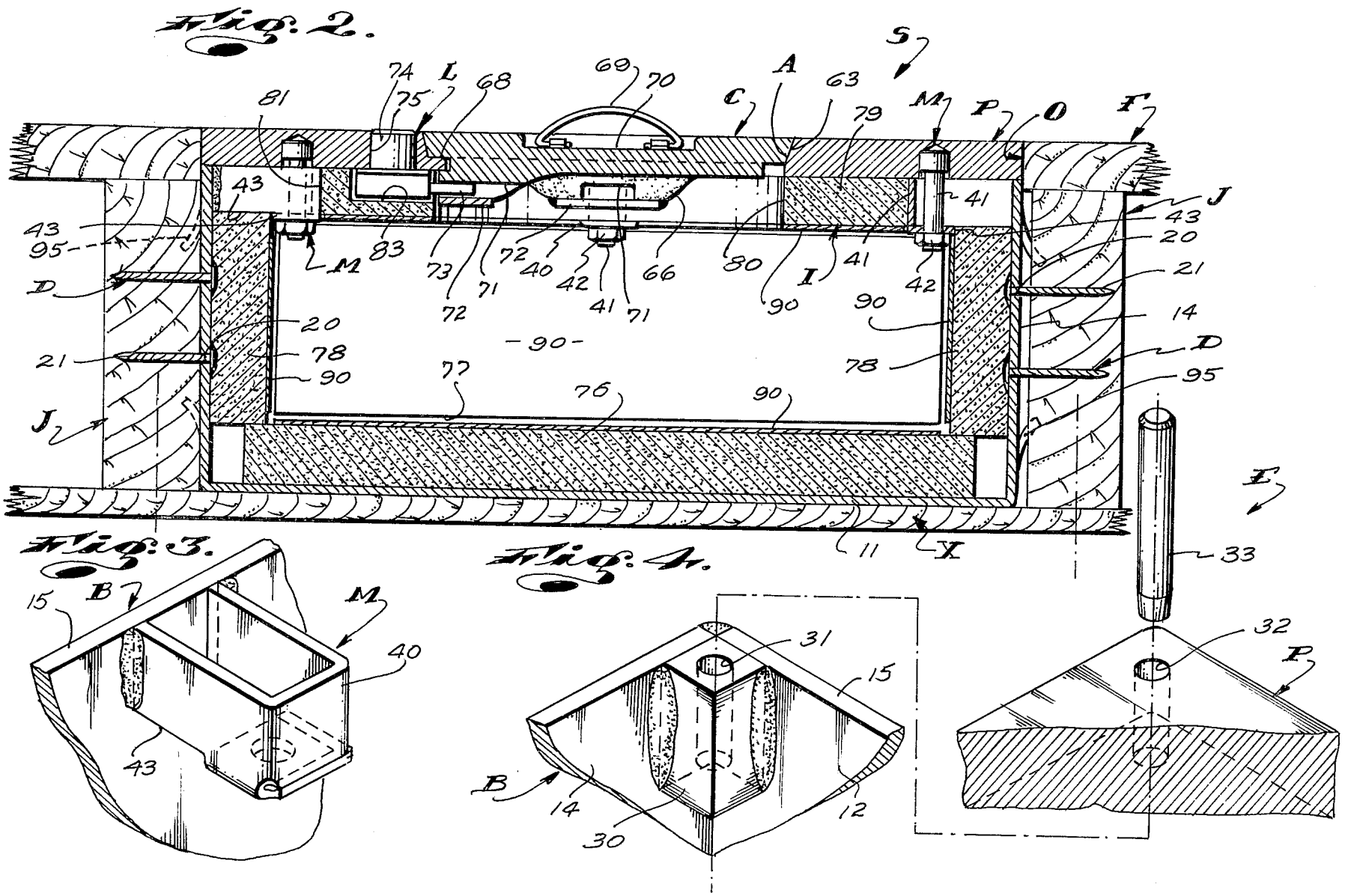
FIG. 2 is a sectional view taken as indicated by line 2—2 On FIG. 1.
FIG. 3 is an enlarged isometric view of a mounting and supporting bracket that I provide.
FIG. 4 is an exploded isometric view of one corner portion of my new safe.
Figure 7:
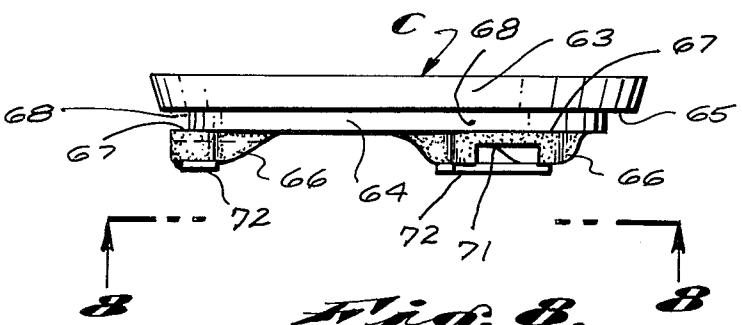
FIG. 7 is a view taken as indicated by line 7—7 on FIG. 1.
Figure 8:
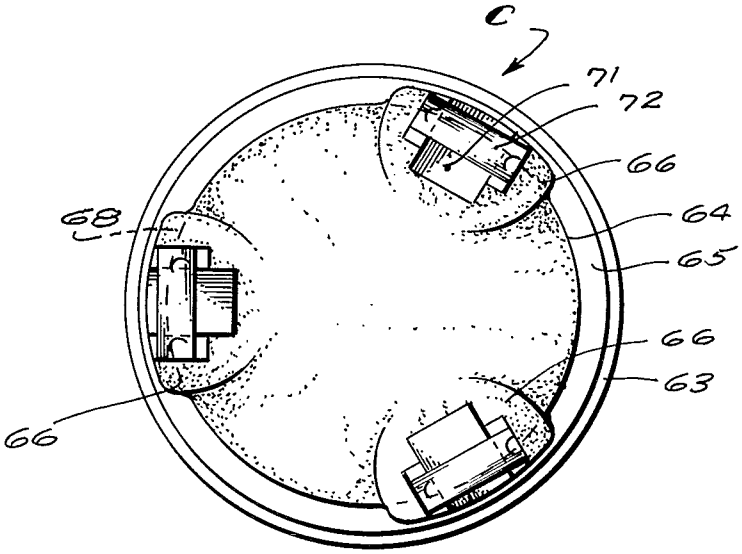
FIG. 8 is a view taken as indicated by line 8—8 on FIG. 7.
Figure 5:
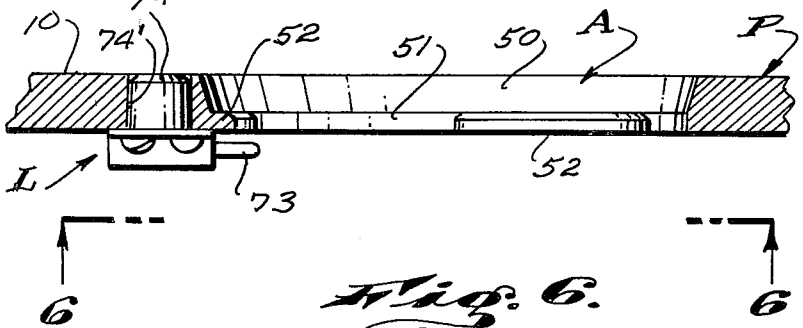
FIG. 5 is a sectional view taken substantially as indicated by line 5—5 on FIG. 1.
Figure 6:
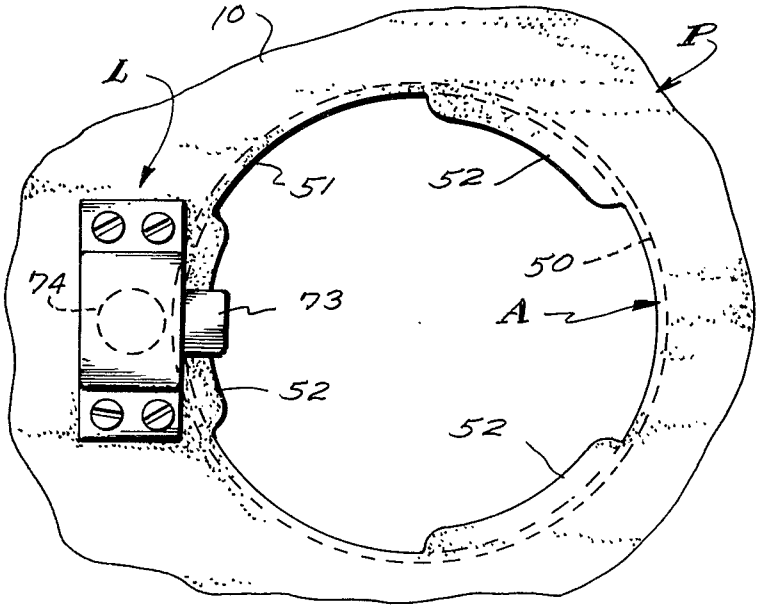
FIG. 6 is a view taken as indicated by line 6—6 on FIG. 5.

The vertical extent of the safe S is $6\frac{7}{8}$ inches, that is, it is equal to the sum of the vertical dimension ($5\frac{7}{8}$ inches) of the joists and the minimum anticipated thickness of the floor F, which is 1 inch. With such a vertical dimension, it will be apparent that the safe S, when arranged in a floor structure with its top 10 flush with the top surface of the floor F, will not depend downwardly from or below the lower edge of the joists. With such a relationship of parts, it is possible to secure a flat ceiling structure or a flat layer or skin of insulation to the underside of the floor structure without interference with the safe S and as illustrated at X in FIG. 2 of the drawings.

It is important to note that with a safe structure with the above noted dimensional limitations, the opening O in the floor F in which the safe is arranged can be easily and quickly established by first drilling a pilot hole in the floor, between a pair of joists and then cutting the opening O by means of a suitable saw or saws initially engageable in the pilot hole.

The joist J which will occur at one side of the opening O serves as an accurate guide for sawing one side of the opening O and provides a suitable base line for laying out lines on the floor for cutting the other sides of the opening. In practice, when the above noted one side of the opening has been cut in the floor F, the safe S can be set on the floor with one side and in some cases, one end, aligned with the cut. With the safe thus arranged and set on the floor, it can be used as a template to scribe or mark lines on the floor for the cuts left to be made.

The safe construction S noted above includes a lower upwardly opening box-like body B established of sheet or plate metal and which defines the noted bottom, side and end walls 11, 12 and 14; and a thick, heavy steel cover plate P to overlie the body B and which defines the top wall 10. The access opening A in which the closure C is normally engaged is formed in the plate P.

The construction S further includes fastening means D securing the body B to related joists J, orienting means E to orient and align the cover plate P with the body B, mounting means M to secure the cover plate to the body and insulating means I.

The upwardly opening box-like body B has a flat horizontal, upwardly disposed sealing edge or rim 15 which is adapted to establish flat uniform substantially sealed engagement with the bottom side or surface of the plate P.

The fastening means D that I provide is extremely simple and includes a plurality of fastener receiving openings 20 in the sides and/or end walls 12 and 14 and elongate headed fasteners 21 engaged through openings 20 from the interior of the body and projecting outwardly from the walls of the body and into engagement in adjacent related joists J. In practice, the fasteners 21 are preferably heat treated spiral nails and are driven outwardly through the openings 20 and into the joists J by means of a hammer. It is to be particularly noted that during the first stages of installationof the safe construction S, the top of the body B is fully open and is such that when it is first engaged in its related floor opening O and between its related joist J, it affords free and ready access to the openings 20 and the fasteners or nails 21 whereby driving the fasteners with a hammer is made a simple and convenient operation.

It will be apparent that screw fasteners can be employed in the place of nails to secure the body B to the joist J without departing from the spirit of this invention.

The orienting means E includes steel corner blocks 30 fixed in each of the four inside corners of the body B as by welding. Each block 30 has a vertical upwardly opening cylindrical dowel pin receiving blind opening 31 and is arranged with its upper end in close proximity to the rim 15 of the body B. The means E next includes vertical dowel pin receiving openings 32 in the four corner portions of the cover plate P. The openings 32 in the plate P are aligned with the openings 31 in the blocks 30 when the plate P is properly arranged in overlying and supported relationship with the body B. Finally, the means E includes elongate dowel pins 33 which are first entered into the upper ends of the openings 32 and then forcibly driven downwardly into full engagement in the openings 32 and into tight engagement in the openings 31. The pins 33 are driven into position, flush with top of cover plate, by means of a hmmer and establish such tight frictional engagement in the openings 31 and 32 that no free relative working of the several parts is possible and so that extraction and/or removal of the pins from the top or by attempts to drive them into the construction is impossible without the use of special equipment and the exercise of special skills.

The means E when made up or put to use effectively and accurately urges and holds the body B in proper aligned relationship with the plate P. Should the body B be warped or distorted so that it would not properly align with the plate P, with the rim 15 in flat engagement with the bottom surface of the plate P, entering and driving the pins 33 into full engagement with the bottom surface of the plate P, entering and driving the pins 33 into full engagement in their related openings 31 and 32, at the four corners of the construction, effectively draws, urges and holds the parts of the construction into desired alignment and assures proper contacting of the rim 15 with the plate P.

It is to be noted at this time that in practice, the rim 15 of the body B and the opposing portions of the bottom surface of the plate P are ground flat or are otherwise finished so that when the construction is in assembled relationship, an effective seal is established between the body and the plate.

The mounting means M that I provide serves to releasably hold the body B and plate P together with the rim 15 in tight clamped engagement with the plate P. The means M is arranged wholly within the safe construction whereby access thereto can be only be had through the access opening A and so that release and separation of the plate from the body B cannot be effected from outside the construction.

The means M includes one or more laterally inwardly projecting apertured brackets 40 on each end and side wall of the body, elongate vertical threaded studs 41 carried by and depending from the bottom surface of the plate P and engageable through the apertures in the brackets 40 and nuts 42 engaged on the lower ends of the studs 41 and advanced upwardly thereon, into engagement with the brackets to draw the plate downwardly relative to the body and to releasably hold the plate and body in tight clamped assembled relationship.

It is of particular importance and it is to be noted that with the structure thus far described, the fastening means D and the releasable mounting means M are only accessible from within the construction and are such that when the construction is installed and the access opening A in the plate P is closed by the closure plate C, no access to the means M and D can be had and disassembly of the construction and its removal from its related floor structure is made substantially impossible.

The access opening A in the top wall 10 or cover plate P is a circular, vertical through opening of substantial diametric extent and is arranged or positioned substantially centrally in the plate. The opening A is sufficiently large to freely accommodate and permit the use of a hand-held wrench, within the construction for making up and/or tightening of the means M.

The opening A has an upwardly and outwardly tapered upper portion 50 and a straight cylindrical lower portion 51. The opening A is next and further provided with three circumferentially spaced radially inwardly projecting breach flanges 52. The flanges 52 are spaced apart 120° on center and are slightly less than 60° in circumferential extent. The flanges 52 are of limited predetermined radial extent.

The closure plate C is a round disc-shaped unit of heavy plate of forged steel. The plate C has flat top and bottom surfaces and a cylindrical exterior or side. The cylindrical exterior or side of the plate is defined by an upwardly and outwardly tapered upper portion 63 which normally cooperatively seats in and establishes sealed engagement in the tapered upper portion 50 of the opening A, a lower radially inwardly offset lower portion 64 which normally occurs radially inward of the lower portion 51 of the opening A and in free running clearance with the inner circumferential edges of the flanges 52. The upper and lower portions 63 and 64 cooperate to define a radially extending downwardly disposed annular flat 65 which normally occurs in a horizontal plane immediately above and overlies the top sides or surfaces of the flanges 52.

The closure C next includes three circumferentially spaced protruberances 66 on the bottom side or surface thereof. The protruberances project radially outwardly from the lower cylindrical side portion 64 of the closure to define vertically disposed circumferentially extending flats 67 which are in vertical spaced opposed relationship with the flat 65 and which cooperate therewith to define three circumferentially and radially outwardly opening breach grooves 68 to slidably receive and accommodate the breach flanges 52. The protruberances 66 and the grooves established thereby are the same in circumferential placement and extent as the flanges 52.

With the above structure, it will be apparent that I provide a simple breach type of retaining means to hold the closure C in engaged relationship in the opening A. This structure is such that upon relative rotation of the closure in the opening so that the flanges 52 are in the grooves 68, the closure cannot be lifted or moved axially upwardly and out of engagement in the opening and that upon relative rotation of the closure in the opening so that the flanges 52 are out of engagement in the grooves 68, the closure C is free to be lifted or moved vertically axially from within the opening A.

To facilitate removal of the closure C from and engagement of the closure C in the opening A, the closure is provided with a manually engageable bale-like handle 69 pivotally mounted in a central upwardly opening recess 70 entering the top surface of the closure C. The bale-like handle 69 is pivotally mounted so that it can be turned down in a horizontal position, adjacent the bottom of the recess, when not in use.

In addition to the foregoing, the protruberances 66 are provided with radially extending downwardly and radially inwardly and outwardly opening bolt receiving channels 71 in their downwardly disposed lowermost sides or portions and are provided with retaining bars or members 72 fixed thereto to overlie the channels 71.

The locking device L that I provide is preferably a key-operated dead bolt lock mounted on and screw fastened to the bottom surface of the cover plate P adjacent the opening A. The lock L is arranged with its elongate axially shiftable bolt 73 extending horizontally and projecting radially inwardly toward the center of the opening A and with its key cylinder 74 projecting upwardly through an aperture 75 in the plate P for free access at the exterior of the construction.

The axis of the bolt is parallel with the mean radial plane of one of the protruberances 66 and is on a common horizontal plane with the grooves 71 when the closure is engaged in the opening A. The lock L is arranged or positioned radially so that when the bolt 73 is in its extended or out position, it enters and extends into a channel or groove 71 of the closure aligned therewith and so that when it is in its retracted or in position, it is spaced radially outward or clear of the grooves 71. With the above relationship of parts, it will be apparent that when the flanges 52 in the opening A are engaged in and aligned with the grooves 68 of the cover C to retain the closure C in the opening A and the bolt 73 of the lock L is shifted to its out or extended position, the bolt enters the channel or groove 71 with which it is aligned and operates to positively prevent rotation of the closure C in the opening A from its retained position therein to a position where the closure might be removed from the opening.

The retaining bars 72 overlying the grooves 71 serve to prevent the bolt 73 from being forcibly urged downwardly and out of the grooves, should the lock L be forced downwardly relative to the cover plate P as by driving the cylinder 74 of the lock downwardly in the opening 75 by means of a punch or the like.

With the above structure and relationship of parts, all attempts to force the safe S open by working upon and/or destruction of the locking device L have failed. Accordingly, the instant structure is to be distinguished from safe structures of the same class here concerned with wherein the locking devices are arranged in and carried by the closures and which are such that working upon and/or destruction of the locking devices is oftentimes effective to free the closure and gain access to the interior of the safe.

The insulating means I that I provide is a separable means which is engageable in and with the body B after the body B is secured in its related floor structure by the fastening means D and before the cover plate P is arranged on the body and secured thereto by the means M.

Figure 10:
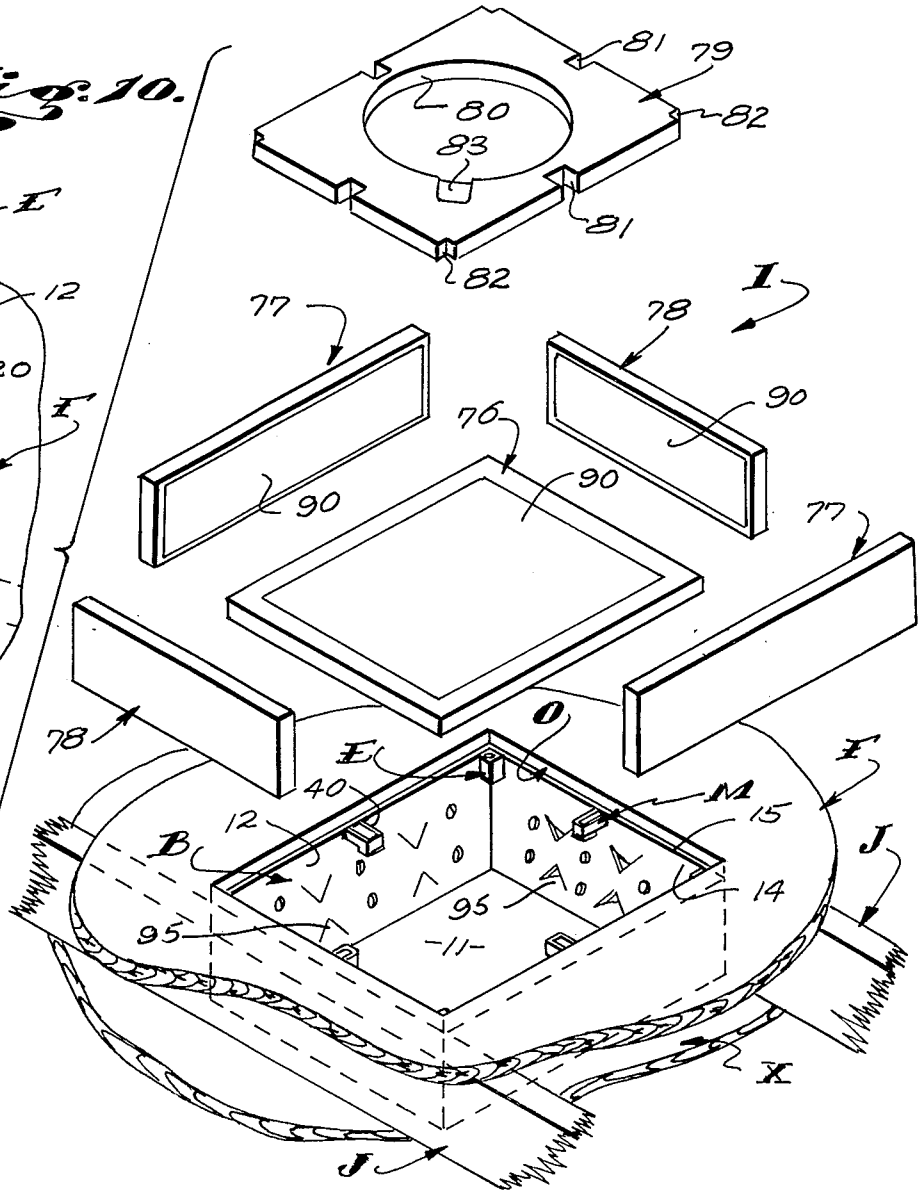
FIG. 10 is an exploded isometric view of a portion of the construction to illustrate assembly procedures.
Figure 9:
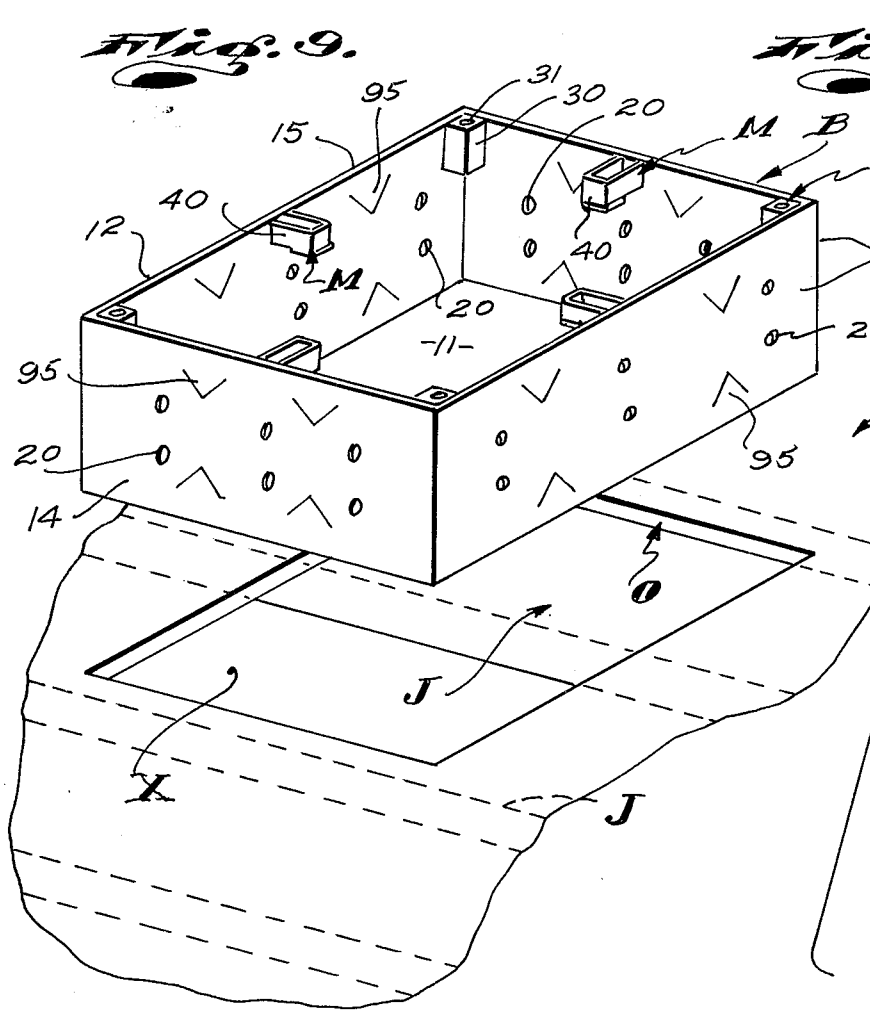
FIG. 9 is an isometric view illustrating certain installation procedures.

Referring to FIG. 10 of the drawings, the means I includes a flat, rectangular bottom tile 76 of mica and fire-clay (bonded with a suitable cement) about 1 inch thick. The tile 76 is equal in lateral extent with the interior of the body and is equal or slightly less in longitudinal extent with the interior longitudinal extent of the body.

The tile 76 is entered into the body and arranged in flat supported engagement on the bottom wall 11 thereof, after the body is fastened in the floor structure by the means D. The tile 76 effectively insulates the interior space of the safe, across the bottom wall 11 and provides a flat smooth interior surface having a low index of heat conductivity on which items deposited in the safe can rest.

The means I next includes two like, elongate flat vertical 1 inch side tiles 77 of fire-clay with laterally inwardly and outwardly disposed vertical surfaces and top, bottom and end edges. The tiles 77 are substantially equal in inside longitudinal extent with the interior of the body and are about or little more than 2 inches less in vertical extent with the interior vertical extent of the body.

The tiles 77 are entered into the body B, from the open top thereof and are inclined downwardly and outwardly toward and are moved laterally outwardly into engagement with their interior surfaces of their related side walls 12 of the body. The tiles 77 are then turned up and establish flat engagement with the side walls 12, with their lower edges in supported engagement with edge portions of the bottom tile 76 and with their upper edges about 1 inch below the rim 15 of the body. The ends of the tiles 77 occur below and their upper edge portions occur with downwardly opening recesses 43 provided in the brackets 40 of the means M whereby the tiles are held upright and are prevented from tipping and falling inwardly in the body.

The tiles 77 effectively insulate the side walls of the body.

The means I next includes two like, elongate, flat, vertical 1 inch thick end tiles 78. The tiles 78 have flat, vertical, inner and outer surfaces, horizontal top and bottom edges and vertical end edges. The tiles 78 are equal in vertical extent with the side tiles 77 and are about 2 inches less in lateral extent than the lateral extent of the body, or are equal in lateral extent with the distance betweeen the inner opposing surfaces of the tiles 77 when the tiles 77 are engaged in the body.

The tiles 78 are entered into the body after the tiles 77 are engaged therein and are shifted longitudinally therein to engage the end walls 14, bottom tile 71 and the recesses 43 in their related recessed brackets 40 of the means M, in the same manner that the tiles 77 are engaged in the construction. When the tiles are engaged in the construction, their end edges establish opposing bearing contact with the end portions of the inner surfaces of the tiles 77 and their upper edges are about 1 inch below the rim 15 of the body. The tiles effectively insulate the end walls 14 of the body.

Finally, the means I includes a flat horizontal rectangular top tile 79 of fire-clay corresponding, substantially in plan configuration with the plan configuration of the space within the body defined by the side and end walls 12 and 14. The tile 79 is adapted to normally occur adjacent the lower or bottom surface of the cover plate P to effectively insulate that plate.

The tile 79 has a central round vertical opening 80 corresponding in diameter and normally registered with the opening A in the plate P and is provided with vertical and laterally outwardly opening notches 81 in its four sides to cooperatively receive and accommodate the brackets 40 of the means M projecting inwardly from related side walls of the body B and notches 82 at its four corners to accommodate the the corner blocks 30 of the means E in the corners of the body.

In addition to the above, the top surface of the tile 79 is relieved or is provided with a radially inwardly and upwardly opening recess 83 adjacent to and extending radially outward from the opening 80 to accommodate the locking device L which is fixed to and which depends from the bottom surface of the plate P adjacent the opening O therein.

After the several tiles 76, 77 and 78 are in place, the tile 79 is lowered into engagement in the body and is stopped and supported therein by the upper edges of the tiles 77 and 78 with its top surface substantially flush with the rim 15 of the body B.

With the several tiles of the means I thus arranged in the floor mounted body, the construction is ready to receive and to be closed by the plate P.

After the plate P is arranged, oriented and releasably secured to the body, as noted in the foregoing, the installation of the safe is complete and ready to releasably receive the cover plate C.

It is to be particularly noted that to enable manual access to and engagement of the nuts 42 of the means M from above the safe and through the opening A, after the cover plate P is in position, the brackets 40 of the means M which are fixed to and project inwardly from the side and end walls of the body, must project a substantial distance inward into the body. Accordingly, the brackets 40 are provided with horizontal laterally inwardly projecting outer portions equal in vertical and longitudinal extent with the thickness of the tiles of the means I and inner portions which are greater in vertical extent than the thickness of the tiles. The tops of the inner and outer portions of the brackets are on a common plane while the bottoms of the outer portions are on planes below the bottom planes of the inner portions whereby the lower inner portion of the brackets, where the stud engaging nuts 42 of the means M engage the brackets, are inward of the side and end tiles and slightly below the bottom surface of the top tile, as clearly shown in the drawings. Further, the inner and outer portions of the brackets 40 cooperate to define the above noted tile edge receiving recesses 43.

In practice, the several tiles of the means I are rather soft or fragile and are sufficiently easy to reduce under directly applied forces so that when the tiles are forced and urged into engagement with small or minor obstructions in the construction, such as the heads on the fasteners 21 of the means D, or portions of the corner blocks 30 and/or brackets 40 which might be positioned to establish interfering fit with the tiles allow for full engagement and proper positioning of the tiles.

In practice, to facilitate proper orientation of the several tiles; to structurally reinforce the tiles; and to provide a durable inside surface for the safe structure, the inside safe compartment defining surfaces of the tiles can be and are preferably provided with durable skins 90 of sheet material such as fire-retardant treated paper or fabric suitably cemented to the surfaces of the tiles.

Finally, as shown in the drawings, the several walls 12 and 14 of the body B are provided with suitably located vertically and downwardly convergent V-shaped piercings which define outwardly bindable joist engaging teeth 95. The teeth 95 are such that they can be bent outwardly and into engagement in and with the joist by means of a punch or screw driver and a hammer. The teeth 95 are particularly united for bridging gaps or clearances between the body and the joist that might occur therebetween and effectively eliminate the need for and use of skins or the like which might otherwise be required to securely position and fix the body with and between a pair of related joists.

In addition to the above, the teeth 95 supplement the means D and are so shaped and disposed, when bent out, to effectively bite into related joists in such a manner that the forces applied to the construction to move or drive the body vertically upwardly and downwardly only serve to urge the teeth into further, deeper and more positive engagement in and with the joists.

Having described my invention, I claim:

1. In combination, a wood floor structure including at least two elongate laterally spaced and parallel floor joists with flat, vertical opposing sides, and a flat horizontal floor in overlying fixed supported engagement with the joists and having a vertical rectangular opening between the joists, a floor safe including a rectangular upwardly opening box-like metal body with a flat horizontal bottom wall and flat vertical side walls with upper edges defining an upwardly disposed rim about the open top of the body, said body corresponding generally in plan configuration with the opening in the floor and slidably engageable therethrough; said body is arranged between the joists with opposite side walls in substantial flat bearing engagement with said opposing sides of the joists, in alignment with the opening in the floor and with said rims spaced a predetermined distance below the top surface of the floor, fastening means securing the body to the joists and including apertures in said opposite side walls and elongate fasteners engaged through the apertures and into the joists from within the body and through the open top thereof, a flat horizontal cover plate corresponding in plan configuration with the body arranged in the opening in the floor and in overlying relationship with the body with its bottom surface engaged with said rim; said cover plate has a central vertical access opening, coupling means releasably securing the cover plate in tight clamped engagement with the body and comprising laterally inwardly projecting brackets on the side walls, vertical threaded studs on the cover plate depending through the brackets and nuts engaged on said studs and advanced upwardly into tight engagement with said brackets, said brackets, studs and nuts being engageable from above the floor through the access opening and at the interior of the body, a closure plate releasably engaged in the access opening and locking means carried by the cover plate and releasably engaging the closure plate to releasably secure the closure plate in the access opening.

2. The combination floor structure and safe set forth in claim 1 which further includes heat insulating means comprising flat horizontal top and bottom tiles and flat vertical side tiles of heat insulating material arranged within the body and below the cover plate in flat engagement with related bottom and side walls of the body and with said cover plate; the top tile has a central opening registering with the access opening.

3. The combination floor structure and safe set forth in claim 2 wherein the access opening and closure plate are round and which further includes breach type retaining means between the cover plate and closure plate, said retaining means including circumferentially spaced circumferentially and radially inwardly opening arcuate channels about the perimeter of the access opening and circumferentially spaced radially inwardly projecting arcuate flanges about the perimeter of the closure plate and shiftable circumferentially into and out of engagement in the channels when the closure plate is engaged in the access opening and is rotated.

4. The combination floor structure and safe set forth in claim 3 wherein said lock means includes a radially outwardly opening groove in the closure plate on a plane below the bottom of the cover plate, a key operated dead bolt lock device fixed to the bottom of the cover plate adjacent the access opening and having a key cylinder projecting upwardly through an aperture in the cover plate and an elongate axially shiftable bolt shiftable radially inwardly and outwardly into and out of engagement in said groove.

5. The combination floor structure and safe set forth in claim 4 which further includes orienting means to urge and maintain the cover plate and body in aligned assembled relationship and including blocks fixed in the four inside corners of the body, vertical aligned openings in said blocks and the four corner portions of cover plate and elongate vertical dowel pins forcibly engaged in the aligned openings and extending between the cover plate and the blocks.

6. The combination floor structure and safe set forth in claim 1 wherein the access opening and closure plate are round and which further includes breach type retaining means between the cover plate and closure plate, said retaining means between the cover plate and closure plate, said retaining means including circumferentially spaced circumferentially and radially inwardly opening arcuate channels about the perimeter of the access opening and circumferentially spaced radially inwardly projecting arcuate flanges about the perimeter of the closure plate and shiftable circumferentially into and out of engagement in the channels when the closure plate is engaged in the access opening and is rotated.

7. The combination floor structure and safe set forth in claim 6 wherein said lock means includes a radially outwardly opening groove in the closure plate on a plane below the bottom of the cover plate, a key operated dead bolt lock device fixed to the bottom of the cover plate adjacent the access opening and having a key cylinder projecting upwardly through an aperture in the cover plate and an elongate axially shiftable bolt shiftable radially inwardly and outwardly into and out of engagememt in said groove.

8. The combination floor structure and safe set forth in claim 7 which further includes orienting means to urge and maintain the cover plate and body in aligned assembled relationship and including blocks fixed in the four inside corners of the body, vertical aligned openings in said blocks and the four corner portions of cover plate and elongate vertical dowel pins forcibly engaged in the aligned openings and extending between the cover plate and the blocks.

9. The combination floor structure and safe set forth in claim 1 wherein said lock means includes a radially outwardly opening groove in the closure plate on a plane below the bottom of the cover plate, a key operated dead bolt lock device fixed to the bottom of the cover plate adjacent the access opening and having a key cylinder projecting upwardly through an aperture in the cover plate and an elongate axially shiftable bolt shiftable radially inwardly and outwardly into and out of engagement in said groove.

10. The combination floor structure and safe set forth in claim 9 which further includes orienting means to urge and maintain the cover plate and body in aligned assembled relationship and including blocks fixed in the four inside corners of the body, vertical aligned openings in said blocks and the four corner portions of cover plate and elongate openings and extending between the cover plate and the blocks.

* * * * *